US006942744B2

(12) United States Patent
Palmer

(10) Patent No.: US 6,942,744 B2
(45) Date of Patent: Sep. 13, 2005

(54) EMULSION EXPLOSIVE

(75) Inventor: Anthony Martin Palmer, Hillsborough (AU)

(73) Assignee: Orica Explosives Technology PTY Ltd., Melbourne (AU)

( * ) Notice: Subject to any disclaimer, the term of this patent is extended or adjusted under 35 U.S.C. 154(b) by 6 days.

(21) Appl. No.: 10/297,307

(22) PCT Filed: Oct. 4, 2001

(86) PCT No.: PCT/AU01/01251

§ 371 (c)(1),
(2), (4) Date: Mar. 27, 2003

(87) PCT Pub. No.: WO02/28804

PCT Pub. Date: Apr. 11, 2002

(65) Prior Publication Data

US 2004/0020573 A1 Feb. 5, 2004

(51) Int. Cl.[7] ..... C06B 45/00; D03D 23/00
(52) U.S. Cl. ..... 149/2; 149/109.6
(58) Field of Search ..... 149/2, 109.6

(56) References Cited

U.S. PATENT DOCUMENTS 4,784,706 A * 11/1988 McKenzie ..... 149/46
4,820,361 A * 4/1989 McKenzie et al. ..... 149/2
4,919,179 A * 4/1990 Chattopadhyay ..... 149/2
4,931,110 A * 6/1990 McKenzie et al. ..... 149/46
4,936,933 A * 6/1990 Yabsley et al. ..... 149/109.6
5,244,475 A * 9/1993 Lownds et al. ..... 44/271
5,271,779 A * 12/1993 Engsbraten ..... 149/109.6
5,322,576 A * 6/1994 Aitken et al. ..... 149/109.6
5,346,564 A * 9/1994 Vance et al. ..... 149/109.6
5,834,539 A * 11/1998 Krivohlavek ..... 149/118
5,972,137 A * 10/1999 Wypkema et al. ..... 149/109.6
6,200,398 B1 * 3/2001 Bush ..... 149/46
6,514,361 B1 * 2/2003 Borden ..... 149/109.6

FOREIGN PATENT DOCUMENTS

| | | | |
|---|---|---|---|
| AU | 54623/86 | A | 10/1986 |
| AU | 60817/86 | A | 2/1987 |
| AU | 48876/90 | A | 9/1990 |
| CA | 2173566 | | 10/1996 |
| GB | 2204343 | A | 11/1988 |
| WO | WO 97/48966 | A1 | 12/1997 |
| WO | WO 98/51645 | A1 | 11/1998 |
| WO | WO 99/21809 | A1 | 5/1999 |

OTHER PUBLICATIONS

A. K. Das et al., Langmuir, 1992, vol. 8 (10), pp. 2427–2436.
S. Qu et al., Chemical Abstract 130:340183 & Baopo Qicai 1999, vol. 28 (1), pp. 10–13.

* cited by examiner

*Primary Examiner*—Aileen Felton
(74) *Attorney, Agent, or Firm*—Birch, Stewart, Kolasch & Birch, LLP

(57) ABSTRACT

An emulsion explosive composition is especially suited to being pneumatically loaded into a blasthole. The emulsion explosive composition includes a base emulsion phase which has a continuous fuel phase and a discontinuous oxidiser phase, wherein the viscosity of the base emulsion phase is less than 2000 cP (Brookfleld viscosity #4 spindle at 50 rpm) at 25°C.

23 Claims, No Drawings

EMULSION EXPLOSIVE

This application is the national phase under 35 U.S.C. § 371 of PCT International Application No. PCT/AU01/01251 which has an International filing date of Oct. 4, 2001, which designated the United States of America.

BACKGROUND OF THE INVENTION

1. Field of the Invention

The present invention relates to an explosive composition, in particular to an emulsion explosive composition suitable for loading pneumatically into a blasthole.

2. Description of the Related Art

Water-in-oil emulsion explosive compositions were first disclosed by Bluhm in U.S. Pat. No. 3,447,978 and comprise (a) a discontinuous aqueous phase comprising discrete droplets of an aqueous solution of inorganic oxygen-releasing salts; (b) a continuous water-immiscible organic phase throughout which the droplets are dispersed and (c) an emulsifier which forms an emulsion of the droplets of oxidiser salt solution throughout the continuous organic phase. Where these types of emulsions comprise very little water or adventitious water only in the discontinuous phase they are more correctly referred to as melt-in-fuel emulsion explosives.

Water-in-oil emulsion explosive compositions are generally viscous and require pumping and or auguring into a blasthole. Pumping and auguring equipment is generally expensive and the use of emulsion explosives in certain applications is limited because of the availability of such equipment at a cost effective price. Pumping of emulsion explosives is also generally undesirable due to the risk of accidental explosion due to heat or pressure build-up arising from a failure in the pumping mechanism.

ANFO-based explosive compositions may be pneumatically loaded into a blasthole. Compressed air is used to blow ANFO-based explosive compositions into a variety of blastholes including upholes. Even the so called "heavy ANFO" compositions which include a small amount of emulsion explosive blended with the ANFO are capable of being blow loaded. However, emulsion explosive compositions are themselves not generally suited for blow loading.

Pneumatic loading of emulsion explosive compositions has been proposed in, for example, British patent specification 2204343 and International patent application WO 97/48966. However, in both these proposals means is required to form a lubricating layer between the emulsion explosive composition, or the base emulsion phase, and the interior of a delivery hose.

SUMMARY OF THE INVENTION

We have now found an emulsion explosive composition which is especially suited to being pneumatically loaded into a blasthole. Accordingly, there is provided an emulsion explosive composition comprising a base emulsion phase which comprises a continuous fuel phase and a discontinuous oxidiser phase, wherein the viscosity of the base emulsion phase is less than 2000 cP (Brookfield viscosity #4 spindle at 50 rpm) at 25° C.

The viscosity of the emulsion phase used in practice of the present invention is lower than that of corresponding components used in conventional explosive compositions. In turn, this reduced viscosity enables emulsion explosive compositions having reduced viscosity to be prepared. Such compositions may therefore be pneumatically loaded at pressures lower than previously required without the need for a pump.

DETAILED DESCRIPTION

In one embodiment of the present invention the characteristics of the discontinuous oxidiser phase of the emulsion explosive composition enable useful base emulsion phases having low viscosity to be prepared. In a preferred embodiment the discontinuous oxidizer phase comprises a mixture of at least two oxygen-releasing salts. More specifically, the discontinuous phase may be a eutectic or substantially eutectic composition, that is the melting point of the composition is at or in the region of the eutectic of the component salts of the discontinuous phase. For the purpose of the present invention a substantially eutectic composition is one in which the water content is within about 10% by weight, for instance within about 5% by weight, of the water content of a eutectic composition. The main benefit of this is that the discontinuous phase has the maximum, or close to the maximum, amount of salts in solution without any increase in the crystallisation temperature. In other words, use of a eutectic or substantially eutectic composition enables the amount of water in the discontinuous phase to be minimised thereby providing an internal phase with the maximum, or close to the maximum, possible positive oxygen balance. This enables a higher level of fuel to be included in the base emulsion phase at a given oxygen balance relative to a non-eutectic system. Increasing the proportion of the fuel advantageously reduces viscosity. In part this is because in an emulsion with a high fuel phase ratio the droplets of discontinuous phase have to undergo less deformation before flow can occur because the droplets are distributed further apart. In other words, use of a high fuel phase ratio reduces inter-droplet friction on flow of the emulsion. The result is enhanced flow/reduced emulsion viscosity. The eutectic composition enables low viscosity to be achieved without compromising properties such as oxygen balance, sensitivity, energy and blasting performance. The use of a low viscosity product enables acceptable charging rates to be achieved without the need for complicated delivery equipment.

The oxygen-releasing salts may be selected from alkali and alkaline earth metal nitrates, chlorates and perchlorates, ammonium chlorate, ammonium perchlorate, and mixtures thereof. Preferably, one salt is ammonium nitrate and the other is either calcium nitrate or sodium nitrate. More preferably the mixture comprises ammonium nitrate and calcium nitrate.

Typically the oxygen-releasing salts included in the compositions of the present invention form from 75 to 100% w/w, preferably from 75 to 96% w/w, and more preferably from 78 to 94% w/w of the discontinuous oxidiser phase. In compositions where the oxidiser component comprises a mixture of ammonium nitrate and calcium nitrate, the preferred composition range for such blends is from 50 to 150 parts by weight of calcium nitrate for every 100 parts by weight of ammonium nitrate. In compositions where the oxidizer component comprises a mixture of ammonium nitrate and sodium nitrate, the preferred composition range for such a blend is from 8 to 45 parts by weight of sodium nitrate for every 100 parts by weight of ammonium nitrate.

Without wishing to be bound by theory it is believed that calcium nitrate is a preferred choice of oxygen-releasing salt due to:

- improved stability—believed to be by co-ordination of water which inhibits water migration;
- reduced viscosity—it has been observed that the viscosity of the base emulsion phase is reduced as a result of the presence of calcium nitrate in the discontinuous oxidiser phase;

increased energy in the emulsion explosive composition—it has been observed that lower water contents are possible using calcium nitrate; and higher positive oxygen balance—essentially the oxidising power of the discontinuous oxidiser phase.

Typically, the base emulsion phase used in emulsion explosive composition has a phase ratio of continuous fuel phase to discontinuous oxidiser phase in the range of from 5:95 to 8:92. In the present invention, we have found that it is preferable, for the purposes of reducing the viscosity of the base emulsion phase, for the phase ratio to be slightly higher, for instance at least 8:92. More preferably the phase ratio is in the range of from 8:92 to 13:87, for example of from 8:92 to 12:88. We have found that it is possible to form emulsion explosive compositions in accordance with the invention having base emulsion phases at phase ratios of greater than 15:85, but such base emulsions are usually undesirable for use in underground applications due to their lack of oxygen balance. It may be possible to employ emulsion explosive compositions having such high phase ratios provided that powerful oxygen releasing agents are incorporated into the emulsion to redress the increased proportion of fuel in the emulsion. The phase ratios referred to herein are expressed in terms of amounts by weight.

Preferably the base emulsion phase suitable for use as an explosives emulsion is a water-in-oil or melt-in-oil emulsion or melt-in-fuel emulsion. Typically the amount of water employed in the discontinuous oxidiser phase is in the range of from 0 to 30% w/w of the discontinuous phase. Preferably the amount employed is from 4 to 25% w/w and more preferably from 6 to 20% w/w.

In an embodiment of the invention the discontinuous oxidiser phase has an oxygen balance of greater than 15, preferably greater than 20. The oxygen balance of the base emulsion phase is typically from 0 to −15, more preferably 0 to −10.

The continuous fuel phase of the emulsion explosive composition comprises a liquid fuel component. The viscosity of the liquid fuel is usually at most 10 cP at 40° C. The liquid fuel may be a single liquid fuel or a mixture of liquid fuels in which the mixture usually has a viscosity of 10 cP or less at 40° C. Preferably the viscosity of the liquid fuel is 7 cP or less at 40° C. Suitable liquid fuels include aliphatic, alicyclic and aromatic compounds and mixtures thereof. Suitable liquid fuels may be chosen from fuel oil, diesel oil, distillate, furnace oil, kerosene, naphtha, waxes such as microcrystalline wax, paraffin wax and slack wax, paraffin oils, benzene, toluene, xylenes, asphaltic materials, polymeric oils such as the low molecular weight polymers of olefins, animal oils, vegetable oils, fish oils and other mineral, hydrocarbon or fatty oils and mixtures thereof.

In one embodiment, the liquid fuel, or blend of liquid fuels, comprises between about 80 to about 95% by weight of the continuous fuel phase. For instance, the fuel(s) may comprise between 82 and 92%, and preferably approximately 87%, by weight of the continuous fuel phase. Preferably the viscosity of the overall continuous fuel phase is in the range of from 5 to 15 cP at 40° C.

Typically the continuous fuel phase comprises from 2 to 20% w/w of the emulsion explosive composition, although greater amounts (eg. up to 25%) result in further decreased viscosity. Preferably the continuous fuel phase comprises from 5 to 15% w/w of the emulsion explosive composition.

The emulsion explosive composition of the present invention will generally comprise one or more emulsifiers. Typically, the emulsifier will be present in the base emulsion phase. Suitable emulsifiers may be chosen from the wide range of emulsifiers known in the art for the preparation of emulsion explosive compositions, including one of the emulsifiers based on the reaction products of poly[alk(en)yl] succinic anhydrides (such as reaction products with alkylamines, including polyisobutylene succinic anhydride (PiBSA) derivatives of alkanolamines), alcohol alkoxylates, phenol alkoxylates, poly(oxyalkylene)glycols, poly (oxyalkylene)fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amines, fatty acid amide alkoxylates, fatty amines, quaternary amines, alkyloxazolines, alkenyloxazolines, imidazolines, alkylsulphonates, alkylarylsulphonates, alkylsulphosuccinates, alkylarylsulpnonates, alkylsulphosuccinates, alkylphosphates, alkenylphosphates, phosphate esters, lecithin, copolymers of poly(oxyalkylene) glycols and poly(12-hydroxystearic)acid and mixtures thereof.

We have found that polymeric emulsifiers are preferred. It is particularly preferred that the emulsifier comprises an imide derivative of a poly[alk(en)yl] succinic anhydride. This preferred emulsifier may be used either alone or in combination with one or more other emulsifiers such as sorbitan monooleate.

Whilst the use of polymeric emulsifiers may tend to increase the viscosity of the continuous phase, polymeric emulsifiers can provide larger droplets of the discontinuous oxidiser phase. For a given external pressure acting on a droplet the associated internal droplet pressure is influenced by the interfacial tension separating the emulsion phases and the droplet size. If the interfacial tension is increased and/or the droplet radius reduced, the internal droplet pressure will increase and the droplet becomes "harder", i.e. less easy to deform. As flow of an emulsion is facilitated by droplet deformation, to assist flow it is desirable to employ emulsions in which the interfacial tension between the emulsion phases is low and/or in which the droplets are relatively large.

An emulsion composed of large droplets also has reduced interfacial area of contact relative to an emulsion composed of small droplets. This reduces packing so that inter-droplet friction may be reduced. Inter-droplet friction may be a factor in determining the viscosity of an emulsion explosive.

Thus, in a preferred embodiment of the invention, the or each emulsifier provides an emulsion which has relatively low interfacial tension and/or which is composed of relatively large droplets. Preferably the or each emulsifier results in an interfacial tension of 25 mN/m or less, more preferably in the range of from 3 to 25 mN/m. Examples of emulsifiers which provide an emulsion with relatively low interfacial tension include sorbitan monooleate and imide derivatives of a poly[alk(en)yl] succinic anhydride such as the diethanolamine derivative of a polyisobutenyl succinic anhydride.

The mean droplet size in the base emulsion phase is usually in the range of from 5 and 60 micrometres. The preferred mean droplet size within that range is between 20 and 40 micrometres. The most preferred mean droplet size is between 20 and 30 micrometres. The droplet size is dependent upon not only the factors mentioned above but also the method by which the base emulsion phase is manufactured. Low interfacial tension and large droplet sizes are desirable to achieve low viscosity, but these parameters are competing effects. Therefore it is preferable that a manufacturing process is selected which favours the formation and retention of large droplets. We have found that the droplet size may be affected by the rate at which the oxidiser phase is added to the fuel phase, and that it is preferred to add the oxidiser phase quickly to the fuel phase so as to provide a relatively large droplet size in the resulting base emulsion phase. The residence time of the emulsion in the device used to prepare it should also generally be short. When mixers are used it is preferable to employ a low mixer speed and/or a low production rate to minimise the amount of energy imparted to the emulsion. This minimises the creation of new interfaces. In other words, droplet creation and refinement is typically minimised.

Typically, the emulsifier may form up to 5% w/w of the base emulsion phase. Stable emulsions may be formed using relatively low levels of the preferred emulsifier(s) and in order to promote larger droplet size it is preferable to keep the amount of emulsifying agent used to the minimum required to form a stable emulsion. The preferred level of emulsifier is in the range of from 0.1 to 3.0% w/w of the base emulsion phase.

In an embodiment of the invention the characteristics of the emulsifier employed enables useful emulsion explosive compositions having reduced viscosity to be prepared. Such emulsifiers enable stable emulsions to be prepared when the discontinuous oxidiser phase contains only a single oxygen-releasing salt such as ammonium nitrate.

Mechanical mixing devices, such as blenders, pin mills and the like may be used at low rates of revolution and for relatively short refinement times in order to manufacture the base emulsion phase and provide large droplet sizes. The use of lower rates of revolution and short refinement times effectively reduces the shearing of the droplets and hence the amount of unwanted refinement. Mixing devices which rely on fluid turbulence for the formation of the emulsion, such as jet mixers, may be used at low production rates so as to minimise the effect of the turbulence, ie the shearing effect, and provide larger droplets. When a Jet mixer is used to prepare the base emulsion phase the manufacturing rate is typically 5 to 15 kg/min under a pressure of between 30 and 120 kPa and at about 75° C. The resultant emulsion typically has a viscosity of 500 to 1000 cP (Brookfield viscosity #4 spindle at 50 rpm) at 75° C. The base emulsion phase may also be prepared using a Ribbon Blender. Typically, the refinement time is 1 to 40 minutes. The blender speed is 300 to 800 rpm and the resultant viscosity 700 to 1300 cP (Brookfield viscosity #4 spindle at 50 rpm) at 75° C.

Generally emulsions themselves are not detonable and in order to form an explosive composition, the emulsion must be mixed with sensitising agents such as a self explosive (e.g. trinitrotoluene or nitroglycerine) or a discontinuous phase of void agents. Suitable void agents include glass microballoons, plastic microballoons and expanded polymeric (e.g. polystyrene) beads. The emulsions tend to be of such low viscosity that sensitisation by gas bubbles, is not practically possible, the bubbles tending to coalesce and escape the emulsion.

The maximum viscosity of the base emulsion phase of 2000 cP (Brookfield viscosity #4 spindle at 50 rpm) at 25° C. in the explosive emulsion composition according to the invention is of the unsensitised emulsion. Preferably the viscosity of the unsensitised emulsion is in the range of from 700 to 2000 cP (Brookfield viscosity #4 spindle at 50 rpm) at 25° C. After sensitization, the viscosity of the emulsion explosive composition maybe in the range of from 3000 to 5000 cP (Brookfield viscosity #4 spindle at 50 rpm) at 25° C. We have found that it is preferable for the viscosity of the sensitised emulsion explosive composition to be in the range of from 3000 to 4000 cP (Brookfield viscosity #4 spindle at 50 rpm) at 25° C. as this appears to provide an optimum balance between sensitivity and a viscosity which is capable of pneumatic delivery. Typically the density of the sensitised emulsion explosive composition is in the range of from 1.13 to 1.26 g/cc. For small diameter blastholes, of less than 60 mm diameter, the sensitised emulsion typically has a density of about 1.16 g/cc. For larger blastholes, the density is usually about 1.22 g/cc.

If desired, other optional fuel materials, hereinafter referred to as secondary fuels may be incorporated into the base emulsion phase in addition to the water immiscible organic fuel phase. Examples of such secondary fuels include finely divided solids and water miscible organic liquids which can be used to partially replace water as a solvent for the oxygen releasing salts or to extend the aqueous solvent for the oxygen releasing salts. Typically any optional secondary fuel component of the composition of the present invention comprises less than 30% w/w of the total composition.

It lies within the invention that there may also be incorporated into the base emulsion phase other substances or mixtures of other substances which are oxygen-releasing salts or which are themselves suitable as explosive materials. For example the base emulsion phase may be mixed with prilled or particulate ammonium nitrate or ammonium nitrate/fuel oil mixtures.

A water-in-oil base emulsion phase composition may be prepared by any of a number of different methods. One preferred method of manufacture includes dissolving the oxygen releasing salts, as described above, in water at a temperature above the crystallisation temperature of the salt solution, preferably at a temperature in the range from 20 to 110° C. to give an aqueous salt solution and combining the aqueous salt solution, a water immiscible fuel phase, and an emulsifier with mixing to form a water-in-oil emulsion.

In another aspect the present invention provides a method of loading a blasthole comprising the steps of:

a) preparing an emulsion explosive composition, as described herein; and b) loading the composition into the blasthole.

The composition may be loaded into the blasthole by any convenient means. For instance, the composition may be pumped by pumps such as progressive cavity pumps, rotary lobe pumps (rubber rotor) through plastic or rubber hoses of various diameter/length depending on type of boreholes or applications.

The main advantage associated with the present invention is that the emulsion explosive composition of the present invention may be delivered to a blasthole without the need for complicated and expensive pumping equipment. As pumping equipment is not used the accompanying hazards are eliminated. Thus, the composition may be delivered using a simpler, safer and more robust loading device thereby enabling more widespread usage. For instance, the low viscosity composition of the present invention may be delivered through a small diameter hose without the need for hose lubrication, using only mine air pressure as the driving force. This is particularly important for applications requiring small diameter blastholes. This simplifies the delivery process and avoids the desensitising effects which can be associated with hose lubrication. Pumpless delivery without the requirement for hose lubrication represents a significant advantage in the art. When compared with current methods involving packaged explosives, the present invention enables much faster blasthole charging and full blasthole coupling.

The invention further provides a method of blasting which comprises loading the emulsion explosive composition into a blasthole and then detonating the composition. Detonation may be achieved using conventional means.

The compositions of the present invention are well-suited for use in short small diameter blastholes. They are therefore useful in tunnelling applications in lifter and knee-holes, and in pipeline trenching applications. The viscosity of the compositions of the invention is such that they are not suitable for use in ground which is not competent: where the ground contains cracks, the composition tends to flow into the cracks and is dissipated.

The present invention will now be further described with reference to the following non-limiting examples. Note all percentages given are by mass and refer to the composition of the final sensitised explosive including voids (glass microballoons). All percentages refer to pure components. Bracketed percentages for oxidiser and fuel phases refer to composition of base emulsion phase only.

EXAMPLES

The explosive compositions of Examples 1 to 5 having the compositions as shown in Table 1 were prepared according to the following procedure.

TABLE 1

| | Examples | | | | |
|---|---|---|---|---|---|
| | 1 | 2 | 3 | 4 | 5 |
| Oxidiser phase (%) | 86.0 (90) | 86.0 (90) | 86.0 (90) | 86.0 (90) | 86.0 (90) |
| Ammonium Nitrate (%) | 47.7 | 47.9 | 54.2 | 48.9 | 47.7 |
| Calcium Nitrate (%) | 27.2 | 27.3 | — | 20.4 | 27.2 |
| Sodium nitrate (%) | — | — | 18.9 | — | — |
| Water (%) | 11.1 | 11.2 | 12.9 | 16.7 | 11.1 |
| Continuous fuel phase (%) | 9.6 (10) | 9.6 (10) | 9.6 (10) | 9.6 (10) | 9.6 (10) |
| Fuel Oil (Paraffin Oil) (%) | 8.0 | 8.32 | 8.32 | 7.3 | 8.64 |
| Emulsifier[1] (%) | 0.96 | 0.96 | 0.96 | 1.9 | 0.96 |
| Emulsifier[2] (%) | 0.64 | 0.32 | 0.32 | 0.4 | — |
| Sensitizer (%) | | | | | |
| Glass Microballons (%) | 4.4 | 4.4 | 4.4 | 4.4 | 4.4 |

Emulsifier[1] is a 1:1 condensation product of polyisobutylene succinic anhydride and ethanolamine.
Emulsifier[2] is sorbitan mono-oleate.

In each example the aqueous oxidiser phase was prepared by mixing the oxidiser phase components. The oxidiser phase composition was heated to about 80° C. and was added to a stirred blend of the continuous fuel phase, including the emulsifier. The paraffin oil fuel has a viscosity of 10 cP at 40° C.

The compositions of Examples 1 and 2 were manufactured in an Elk (Jet Mixer) at production rates of 15 kg/min—i.e. a low rate Elk production run.

The composition of Example 3 was made on a lab scale in the equivalent of a Ribbon Blender. The fuel blend was heated to around 60° C., and oxidiser composition added over a 90 second period. A further 30 seconds refinement was completed.

The composition of Example 4 was manufactured using a Ribbon Blender. Oxidiser composition addition rate was 10 kg/min (over 25 minutes) with a mix speed of 400 rpm. A further 1 minute refinement was completed.

The composition of Example 5 was manufactured on a high rate Elk mixer at a high rate production plant at a production rate of 200 kg/min.

The properties of the water-in-oil emulsion compositions of these examples is given in Table 2 below.

TABLE 2

| Example | Brookfield viscosity (#4 spindle at 50 rpm) at 25° C. (cP) | Overall $O_2$ balance | Relative Effective Energy (%) | Droplet size (μm) |
|---|---|---|---|---|
| 1 | 1200 | −8.9 | 85 | 18.3 |
| 2 | 1040 | −9.1 | 85 | 21.7 |
| 3 | 1420 | −12.8 | 84 | 17.6 |
| 4 | 984 | −15.2 | 78 | 25.0 |
| 5 | 955 | −8.9 | 85 | 28.0 |

The overall $O_2$ balance and relative effective energy values were obtained by theoretical calculations using "Ideal Explosives Code (IDeX)" to calculate ideal explosives properties. The relative effective energy is taken relative to ANFO (density 0.8 g/cc). The droplet size is measured by a microscopy technique.

The compositions of Examples 1 and 2 were charged into 45 mm lifter holes using a pneumatic kettle through a 15 metre long, 20 mm diameter hose. Water displacement was observed during charging from wet holes. Charging rates were approximately from 5 to 10 kilograms per minute with a pneumatic head of 500 to 600 kPa.

The composition of Example 1 had a density of 1.18 g/cc, and on detonation gave a velocity of detonation (VoD) of 4.8–5.0 km/s in 45 mm diameter hard rock blastholes. Detonation was undertaken using a packaged emulsion primer (Magnum 365 size 32×200 cartridge) with an LP series non-electric initiation system. The VoD was measured using a Powerline system. The Powerline system uses a Time-Domain-Reflectometer which sends an electrical signal (pulse) along a coaxial cable and measures the time for the pulse to be reflected from the end of the cable. The coaxial cable is placed along the length of the blasthole within a column of explosive. When the explosive is detonated the coaxial cable is consumed. The Reflectometer measures the rate of change of the coaxial cable length and the velocity of detonation may be derived from this rate of change.

The composition of Example 2 had a density of 1.17 g/cc. Detonation was undertaken as previously using a packaged emulsion primer (Magnum 365 size 32×200 cartridge) with an LP series non-electric initiation system.

The following data are for the composition of Example 3 in unconfined (i.e. cardboard tubes) surface firing tests using a packaged emulsion primer (Magnum 365 size 32×200 cartridge) at a density of 1.18 g/cc. The VoD is measured as described above.

TABLE 3

| Diameter (mm) | VoD (m/s) |
|---|---|
| 28 | — |
| 40 | 4605 |
| 50 | 4669 |
| 60 | 4872 |
| 70 | 4912 |
| 80 | 4987 |

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

What is claimed is:

1. An emulsion explosive composition comprising:

a base emulsion and a sensitising agent to render the emulsion explosive composition detonable, wherein the base emulsion phase comprises a continuous fuel phase and an emulsified discontinuous oxidiser phase, the continuous fuel phase comprising a liquid fuel having a viscosity of at most 10 cP at 40° C., and the discontinuous oxidiser phase comprising a mixture of at least two oxygen-releasing salts in aqueous solution, the relative proportions of the at least two oxygen-releasing salts being selected in order to minimise the amount of water in the aqueous solution, wherein the base emulsion phase has a phase ratio of continuous fuel phase to discontinuous oxidiser phase of at least 8:92, wherein the viscosity of the base emulsion phase is less than 2000 cP (Brookfield viscosity #4 spindle at 50 rpm) at 25° C., and wherein the emulsion explosive composition has a viscosity of 3000 to 5000 cP (Brookfield viscosity #4 spindle at 50 rpm) at 250° C.

2. The composition according to claim 1, wherein the oxygen-releasing salts are selected from the group consisting of alkali and alkaline earth metal nitrates, chlorates and perchlorates, ammonium chlorate, ammonium perchlorate, and mixtures thereof.

3. The composition according to claim 1, wherein one salt is ammonium nitrate and the other is either calcium nitrate or sodium nitrate.

4. The composition according to claim 3, wherein the mixture comprises ammonium nitrate and calcium nitrate.

5. The composition according to claim 1, wherein the oxygen-releasing salts form from 75 to 100% w/w of the discontinuous oxidiser phase.

6. The composition according to claim 1, wherein the discontinuous oxidiser phase has an oxygen balance of greater than 15.

7. The composition according to claim 1, which comprises a polymeric emulsifier.

8. The composition according to claim 1, wherein the phase ratio is from 8:92 to 13:87.

9. The composition according to claim 1, which comprises an emulsifier which results in an interfacial tension of 25 mN/m or less.

10. The composition according to claim 9, wherein the emulsifier results in an interfacial tension of 3 to 25 mN/m.

11. The composition according to claim 1, wherein the base emulsion phase has a mean droplet size of from 5 to 60 $\mu$m.

12. The composition according to claim 11, wherein the mean droplet size is between 20 and 40 $\mu$m.

13. A method of loading a blasthole comprising the steps of:

a) preparing an emulsion explosive composition as claimed in claim 1; and b) loading the composition into the blasthole.

14. A method of blasting which comprises:

loading an emulsion explosive composition as claimed in claim 1 into a blasthole and then detonating the composition.

15. The method according to claim 13, wherein the blasthole is in competent ground.

16. The method according to claim 13, wherein the blasthole is a lifter or knee-hole.

17. The method according to claim 13, wherein the composition is loaded pneumatically into the blasthole through a small diameter hose without the need for hose lubrication.

18. The method according to claim 13, wherein the composition is loaded into the blasthole at a pneumatic head pressure of 500 to 600 kPa.

19. The method according to claim 14, wherein the blasthole is in competent ground.

20. The method according to claim 14, wherein the blasthole is a lifter or knee-hole.

21. The method according to claim 14, wherein the composition is loaded pneumatically into the blasthole through a small diameter hose without the need for hose lubrication.

22. The method according to claim 14, wherein the composition is loaded into the blasthole at a pneumatic head pressure of 500 to 600 kPa.

23. The method according to claim 14, wherein the method is employed in a tunneling application or pipeline trench application.

* * * * *